US007663659B2

(12) United States Patent
Koga et al.

(10) Patent No.: US 7,663,659 B2
(45) Date of Patent: Feb. 16, 2010

(54) IMAGE FORMING APPARATUS AND CONTROL METHOD THEREFOR

(75) Inventors: Katsuhide Koga, Moriya (JP); Shigeo Hata, Toride (JP); Yasuyuki Aiko, Toride (JP); Akihiko Sakai, Abiko (JP); Takashi Nagaya, Moriya (JP); Takashi Birumachi, Kashiwa (JP); Shingo Kitamura, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 12/013,088

(22) Filed: Jan. 11, 2008

(65) Prior Publication Data

US 2008/0117279 A1 May 22, 2008

Related U.S. Application Data

(63) Continuation of application No. 11/295,137, filed on Dec. 6, 2005, now Pat. No. 7,463,279.

(30) Foreign Application Priority Data

Dec. 7, 2004 (JP) ..... 2004-354697

(51) Int. Cl.
*B41J 2/435* (2006.01)
*B41J 2/47* (2006.01)

(52) U.S. Cl. ..... 347/246; 347/236; 347/248; 347/253

(58) Field of Classification Search ..... 347/248, 347/246, 236, 253
See application file for complete search history.

(56) References Cited

U.S. PATENT DOCUMENTS

| | | | | |
|---|---|---|---|---|
| 5,407,720 | A * | 4/1995 | Omata | 428/64.4 |
| 5,517,328 | A | 5/1996 | Wilson | |
| 6,002,413 | A | 12/1999 | Nishizawa et al. | |
| 6,222,578 | B1 | 4/2001 | Tanibata | |
| 6,281,922 | B1 | 8/2001 | Suzuki | |
| 6,377,381 | B1 | 4/2002 | Matsuo | |
| 6,396,529 | B1 | 5/2002 | Miyoshi et al. | |
| 6,688,724 | B2 * | 2/2004 | Miyagawa et al. | 347/38 |

(Continued)

FOREIGN PATENT DOCUMENTS

JP 7-174995 A 7/1995

(Continued)

OTHER PUBLICATIONS

Office Action issued in corresponding Japanese Patent Application No. 2004-354697 dated Oct. 9, 2009.

*Primary Examiner*—Stephen D Meier
*Assistant Examiner*—Sarah Al-Hashimi
(74) *Attorney, Agent, or Firm*—Rossi, Kimms & McDowell, LLP

(57) ABSTRACT

An image forming apparatus forms an image by laser beams from a plurality of lasers. The image forming apparatus includes a light amount control circuit that detects displacement in a sub-scanning direction of the main scanning line of a laser beam from the predetermined laser, from a reference position. The apparatus decides an allotted amount of light for each of the plurality of lasers in accordance with the detected displacement and controls to drive each of the plurality of lasers in accordance with the decided allotted amount of light for each laser.

8 Claims, 9 Drawing Sheets

U.S. PATENT DOCUMENTS

2002/0003568 A1* 1/2002 Koga ..... 347/249
2002/0018250 A1* 2/2002 Kato ..... 358/481
2002/0113856 A1* 8/2002 Suzuki ..... 347/133
2003/0156183 A1 8/2003 Ishihara
2003/0211714 A1* 11/2003 Yamazaki et al. ..... 438/487
2004/0012844 A1 1/2004 Ohtsuki et al.
2004/0145985 A1 7/2004 Osakabe
2004/0240894 A1* 12/2004 Tomita et al. ..... 399/17

FOREIGN PATENT DOCUMENTS

JP 09-146324 A 6/1997

* cited by examiner

FIG. 9

| DISPLACEMENT | | A | B | C | D |
|---|---|---|---|---|---|
| 0 | | 1 | 4 | 4 | 1 |
| UPWARD | ONE-EIGHTH PIXEL | 1 | 2 | 5 | 2 |
| | ONE QUARTER PIXEL | 1 | 1 | 4 | 4 |
| | HALF PIXEL | 1 | 1 | 3 | 5 |
| DOWNWARD | ONE-EIGHTH PIXEL | 5 | 3 | 1 | 1 |
| | ONE QUARTER PIXEL | 4 | 4 | 1 | 1 |
| | HALF PIXEL | 2 | 5 | 2 | 1 |

IMAGE FORMING APPARATUS AND CONTROL METHOD THEREFOR

This is a continuation of application Ser. No. 11/295,137, filed Dec. 6, 2005.

FIELD OF THE INVENTION

The present invention relates to an image forming apparatus that forms images, by scanning in the main scanning direction laser beams emitted from a plurality of lasers, and to a control method therefor.

BACKGROUND OF THE INVENTION

A laser printer is known in which a semiconductor laser is driven by a modulated signal obtained by modulating an image signal and an electrostatic latent image is formed on a photoconductive drum by a laser beam emitted from the semiconductor laser, so that an image is formed. During printing, if the printer is vibrated, a scanning line of the laser beam is shifted (displaced) in the sub-scanning direction due to the vibration of the optical system or the tilt of the polygon caused by the shock of the vibration. The displacement of the scanning line has resulted in pitch unevenness, and has caused the deterioration in the quality of a printed image. In order to soften the shock and vibration to the optical system including the laser and the mirror and the like, a proposal has been made in which, the optical system is mounted in the main body of the printer via a shock absorber, the enhancement of printing efficiency is achieved (refer to Japanese Laid-Open No. 09-146324).

In order to suppress the pitch unevenness, a damper has been provided on an easy-to-vibrate portion of a printer so that vibration within the printer is not transferred to the optical system, and a method has been employed in which the rigidity of the optical system is enhanced, by employing aluminum die-casting. With regard to the tilt of the polygon, there has been no other method than reducing the profile irregularity, and the foregoing methods for the pitch unevenness and the tilt of the polygon have been significantly costly.

SUMMARY OF THE INVENTION

The object of the present invention is to solve the foregoing problem of the conventional art.

The feature of present invention is to provide with an image forming apparatus and a control method therefor in which, when an image is formed using laser beams from a plurality of lasers arranged in the sub-scanning direction being spaced a predetermined distance apart from each other, by deciding the allotted amount of light for each laser in response to the displacement in the sub-scanning direction, a high-quality image can be formed regardless of the displacement of the laser beam in the sub-scanning direction.

According to the present invention, there is provided with an image forming apparatus for forming an image, by scanning in a main scanning direction laser beams emitted from a plurality of lasers, the image forming apparatus comprising:

detection means for detecting displacement, in a sub-scanning direction, of a main scanning line of a laser beam from one of the plurality of lasers, from a reference position in the sub-scanning direction;

decision means for deciding an allotted amount of light for each of the plurality of lasers in accordance with the displacement detected by the detection means; and control means for controlling to drive each of the plurality of lasers in accordance with the allotted amount of light for each of the plurality of lasers decided by the decision means.

Further, according to the present invention, there is provided with a control method for an image forming apparatus that forms an image, by scanning in a main scanning direction laser beams emitted from a plurality of lasers, the control method comprising:

a detection step of detecting displacement in a sub-scanning direction of a main scanning line of a laser beam from the plurality of lasers, from a reference position in the sub-scanning direction;

a decision step of deciding allotted amount of light for each of the plurality of lasers in accordance with the displacement detected in the detection step; and a control step of controlling to drive each of the plurality of lasers in accordance with the allotted amount of light for each of the plurality of lasers decided in the decision step.

Other features, objects and advantages of the present invention will be apparent from the following description when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 9 depicts an example of table data of an allotting table for allotting the amount of light according to the present embodiment.

DETAILED DESCRIPTION OF THE PREFERRED EMBODIMENTS

Preferred embodiments of the present invention will be explained below in detail with reference to the accompanying drawings. Note that the embodiments below are not intended to limit the present invention which is according to the claims, and that all combinations of features explained in these embodiments are not always essential to the solution of the present invention.

Figure 1:
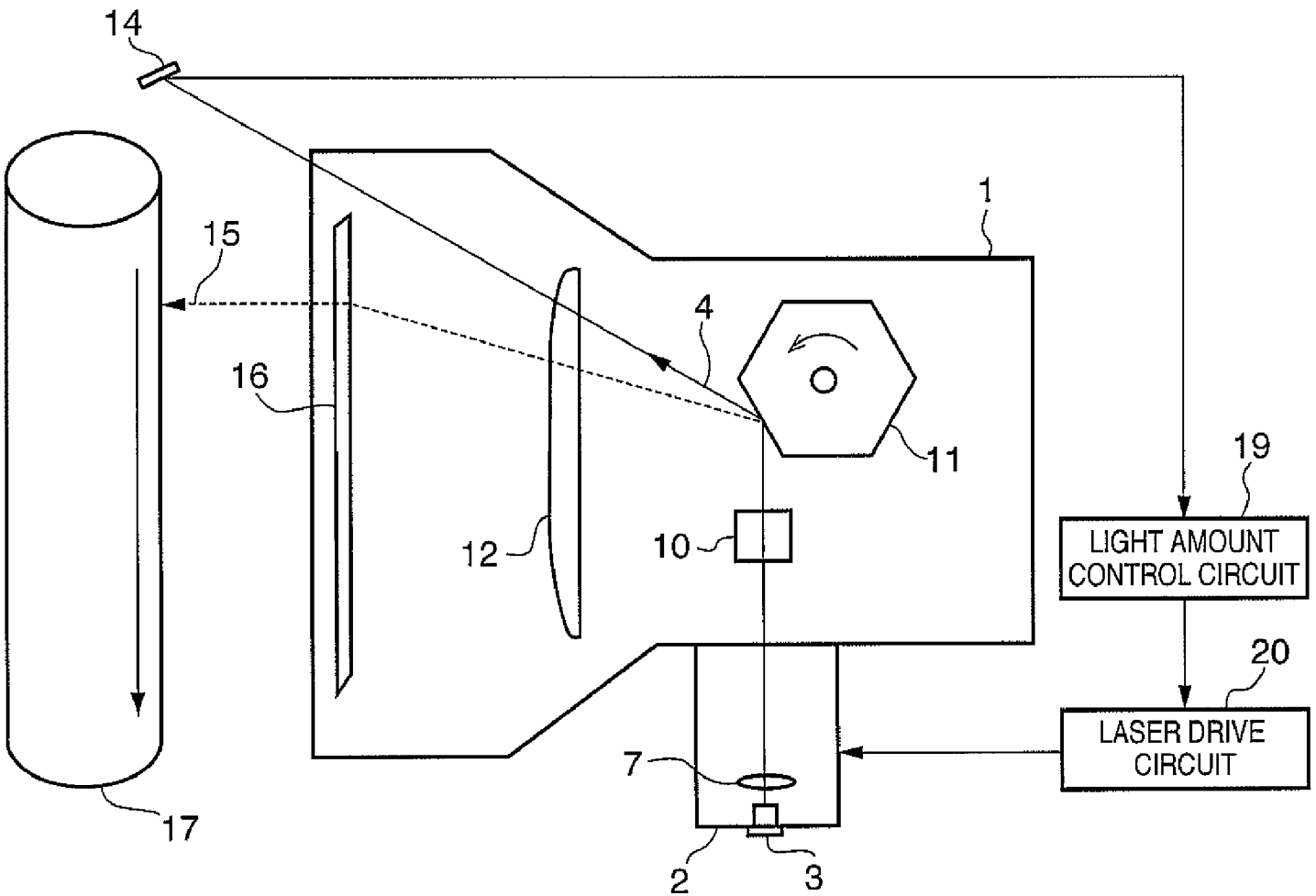
FIG. 1 is a block diagram for explaining the main configuration of the optical scanning unit in an image forming apparatus (laser printer) according to an embodiment of the present invention.

FIG. 1 is a block diagram for explaining the main configuration of the optical scanning unit in an image forming apparatus (laser printer) according to an embodiment of the present invention.

Figure 2:
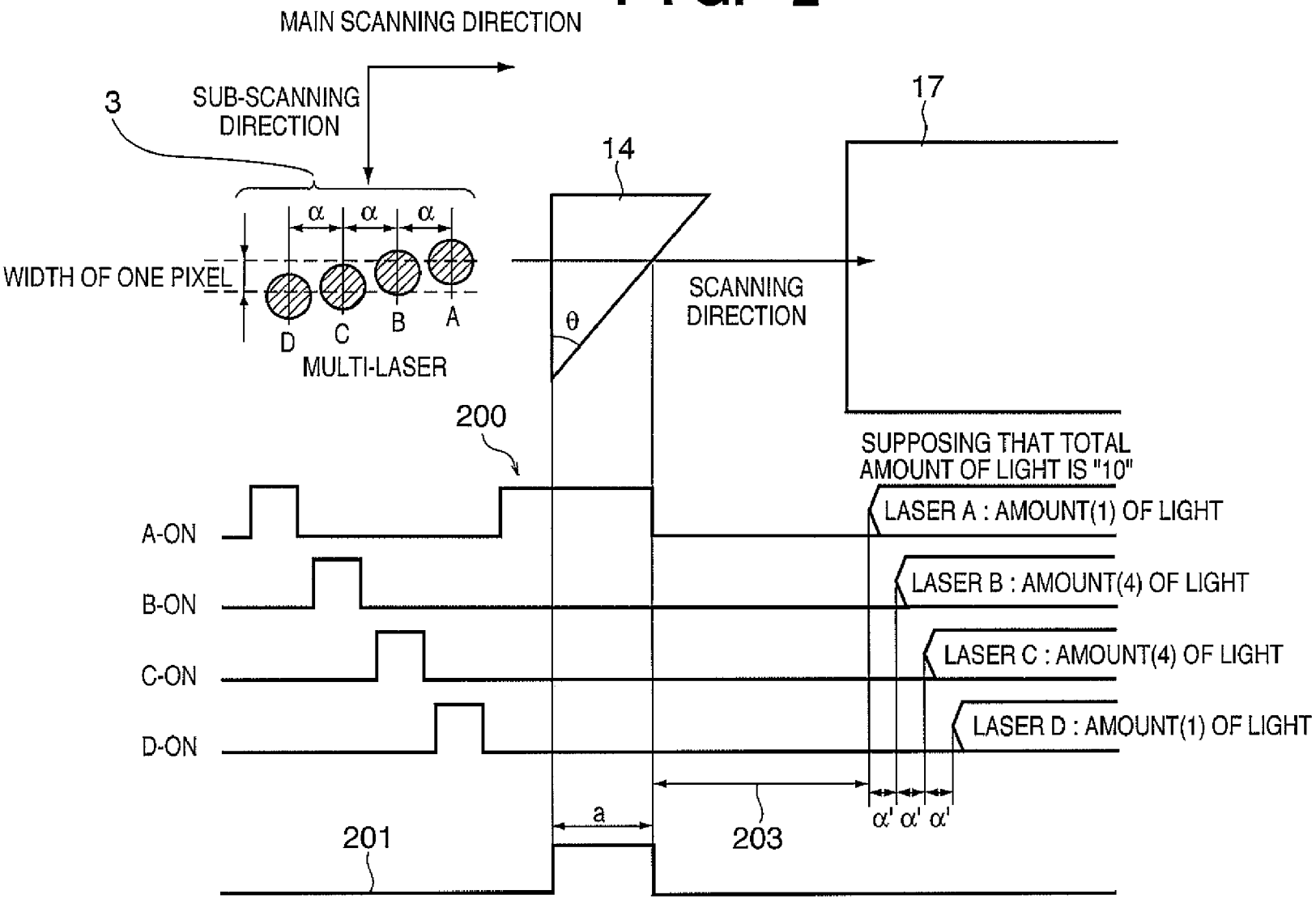
FIG. 2 is a diagram for explaining the relationship among a sensor, a multi-semiconductor laser, a photoconductive drum, and scanning lines by laser beams, and irradiation control signals for respective semiconductor lasers according to the present embodiment.

A laser unit 2 according to the embodiment has a multi-semiconductor laser 3 that emits four laser beams. The multi-semiconductor laser 3 has four semiconductor lasers A to D that are arranged, for example, as illustrated in FIG. 2, being spaced a distance $\alpha$ apart from each other in the main scanning direction and arranged being spaced not longer than one-pixel length apart from each other in the sub-scanning direction. The four semiconductor lasers are driven in such a way that, during a laser-beam scanning in the main scanning direction, at least one semiconductor laser is made to emit a laser beam, and one pixel is formed, by superimposing dots formed using a plurality of laser beams from the four semiconductor lasers, to form an electrostatic latent image of a dot on an image carrier member.

Moreover, the laser unit 2 includes a collimating lens 7 for parallelizing the laser beams emitted from the multi-semiconductor laser 3. A laser beam 4 emitted from the multi-semiconductor laser 3 passes through the collimating lens 7 and a cylindrical lens 10, and reaches a polygon mirror 11. An unillustrated scanner motor rotates the polygon mirror 11 at a constant angular velocity in the direction indicated by an arrow. Accordingly, being reflected by the polygon mirror 11, the laser beam 4 that has reached the polygon mirror 11 is converted by an f-θ lens 12 in such a way as to scan a photoconductive drum 17, at a constant velocity in a direction perpendicular to the rotating direction of the photoconductive drum 17. While the laser beam 4 scans a non-image forming area, when a sensor 14 detects the laser beam 4, a light amount control circuit 19 implements stability control of the amount of the laser beam emitted from each semiconductor laser of the multi-semiconductor laser 3, based on a signal received by the sensor 14. The light amount control circuit 19 further detects a displacement of a scanning line in the sub-scanning direction of each laser beam based on a detection signal from the sensor 14. Intensity of laser beam to be allotted to each semiconductor laser of the multi-semiconductor laser 3 is calculated based on the detected displacement. A laser driving circuit 20 drives each semiconductor laser based on the results of the calculation so as to emit laser beams.

In an image forming area, a laser beam 15 that has been irradiation-controlled by a signal modulated based on an image signal passes, and then irradiates the photoconductive drum 17 through the f-θ lens 12 by way of a reflecting mirror 16. Accordingly, an electrostatic latent image corresponding to the image signal is formed on the photoconductive drum 17. The electrostatic latent image is developed using toner to form a toner image, then the toner image is transferred onto a recording sheet, whereby an image is transferred and printed on the recording sheet.

FIG. 2 is a diagram for explaining the relationship among the sensor 14, the four semiconductor lasers A to D (the Multi-semiconductor laser 3), the photoconductive drum 17, and scanning lines and irradiation control signals for respective semiconductor lasers. In FIG. 2, a case is represented where the sensor 14 is a right-angled-triangle photo sensor. In accordance to the length with which the laser beam 4 traverses the sensor 14, the displacement of scanning line of the laser beam in the sub-scanning direction is detected with respect to the reference position in the sub-scanning direction. In addition, any sensor is utilized as the sensor 14, as long as the sensor can detect the displacement of a scanning line in the sub-scanning direction, for example, a configuration may be acceptable in which, as illustrated in FIG. 4, a CCD 18 is arranged obliquely.

Figure 4:
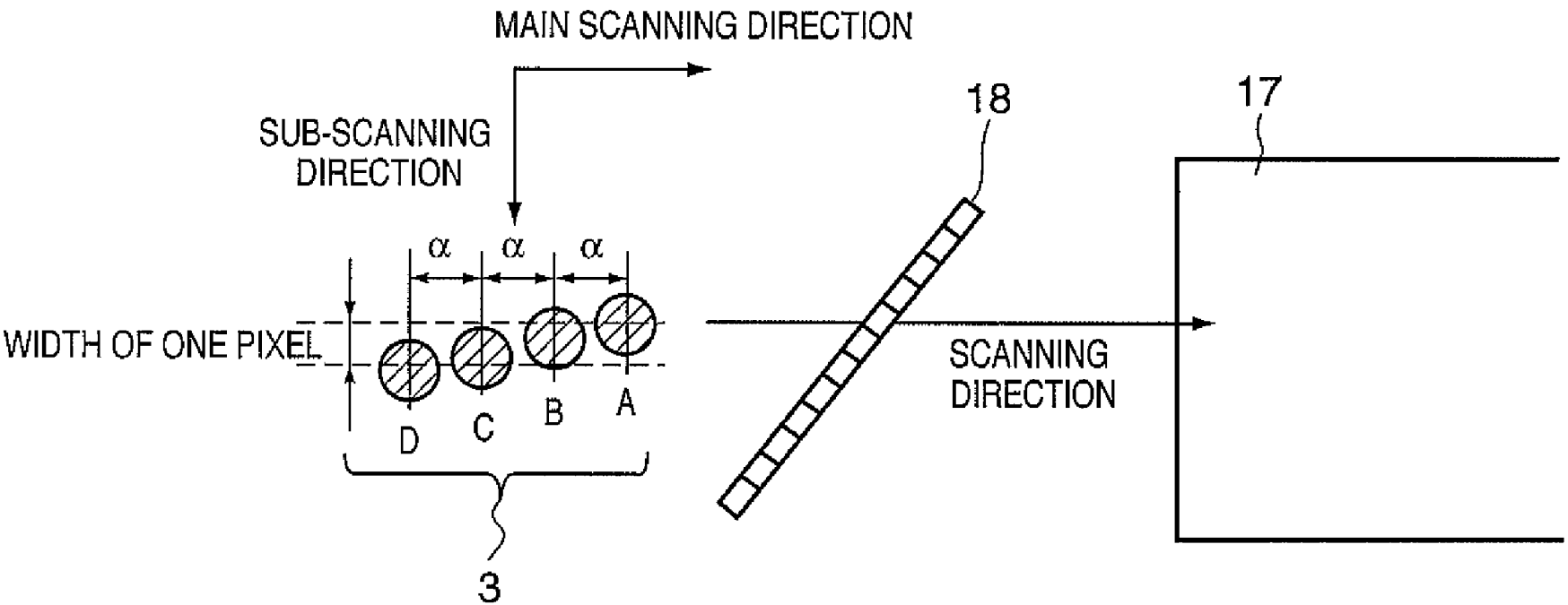
FIG. 4 depicts a view illustrating another aspect of the sensor, for explaining an example of measuring through the obliquely arranged CCD sensor the positional deviation of four laser beams in the sub-scanning direction.

FIG. 4 depicts a view illustrating an example of measuring the positional deviation (displacement) of four laser beams in the sub-scanning direction using the obliquely arranged CCD sensor 18. By utilizing the CCD 18, it is determined which number of an element of the CCD 18 has detected a laser beam. The number of the element that detected a laser beam indicates the displacement of scanning line of the laser beam in the sub-scanning direction.

FIG. 2 illustrates an ideal case where there is no positional deviation of the laser beams in the sub-scanning direction. As illustrated in FIG. 2, the relative positions of the lasers being displaced in the sub-scanning direction, and the four lasers A to D are arranged in series in the main scanning direction, being spaced by a distance $\alpha$ apart from each other. In this situation, the width of each laser beam emitted from each of the semiconductor lasers A to D corresponds to the width of one pixel. By making the four semiconductor lasers A to D emit laser beams and making the polygon mirror 11 rotate, the laser beam 4 scans the sensor 14 and the photoconductive drum 17. In this situation, outside the image forming area and before the laser beam 4 reaches the sensor 14, respective light-amount stabilizing control (APC) for the four semiconductor lasers A to D are implemented.

Here, the semiconductor laser A is firstly made to emit a beam, and after the APC for the semiconductor laser A is completed, the laser A is inactivated. Thereafter, the APC for the semiconductor laser B, the semiconductor laser C, and the semiconductor laser D are implemented in that order.

Next, the reference laser (the semiconductor laser A in this case) is made to emit a laser beam (indicated by reference numeral 200), and the sensor 14 detects the displacement of scanning line in the sub-scanning direction, of a laser beam emitted from the semiconductor laser A. Reference numeral 201 denotes the signal detected as described above. Letting the width ("a" in this case) of the signal 201, when a laser beam from the laser A initially transverses the sensor 14 and an initial value is set "a". If there is no optical vibration and no tilt of the polygon, then the laser beam of the semiconductor laser A always scans the same position, whereby the width "a" with which the semiconductor laser A transverses the sensor 14 remains unchanged from the initial value.

However, if the scanning line of a laser beam from the semiconductor laser A displacement upward in the sub-scanning direction in FIG. 2, the width of the laser beam that transverses the sensor 14 becomes larger than the initial value "a". In contrast, if the scanning line of a laser beam from the semiconductor laser A displacement downward in the sub-scanning direction, the width of the laser beam that transverses the sensor 14 becomes smaller than the initial value "a". Accordingly, the initial value "a" of the width is stored with the scanning line in the sub-scanning position, and the difference between the initial value "a" and a width in which a laser beam traverses the sensor 14 is detected so that it is determined what extent the scanning line of the laser beam is displaced upward or downward sides in the sub-scanning direction.

FIG. 2 illustrates a case where a laser beam from the semiconductor laser A scans a desired sub-scanning position. In this case, because the width of the detection signal 201 of the laser beam from the semiconductor laser A that is detected by the sensor 14 is the same as the initial value "a", it can be determined that, with regard to the laser beam from the semiconductor laser A, no positional deviation in the sub-scanning direction has occurred.

In this case, a dot is formed at the middle position of the four semiconductor lasers in the sub-scanning direction, by making the respective laser beams from the four semiconductor lasers irradiate on the photoconductive drum 17. For that purpose, the driving timing for each semiconductor laser is shifted in the main scanning direction by the time difference "α" corresponding to the distance "α" between the semiconductor lasers. In a case that laser beams from the four semiconductor lasers A to D are overlapped and the total light amount is "10", if the light amounts of the semiconductor A and the semiconductor D are set to "1" and the light amounts of the semiconductor B and the semiconductor C are set to "4", respectively, then electrostatic latent images as illustrated with thin lines 302 and 303 in FIG. 3 can be formed by the four laser beams. Reference numeral 203 indicates a time interval for changing allotted amount of light, in which by determining the amount of light that each semiconductor laser emits, the timing of driving each laser is determined.

Figure 3:
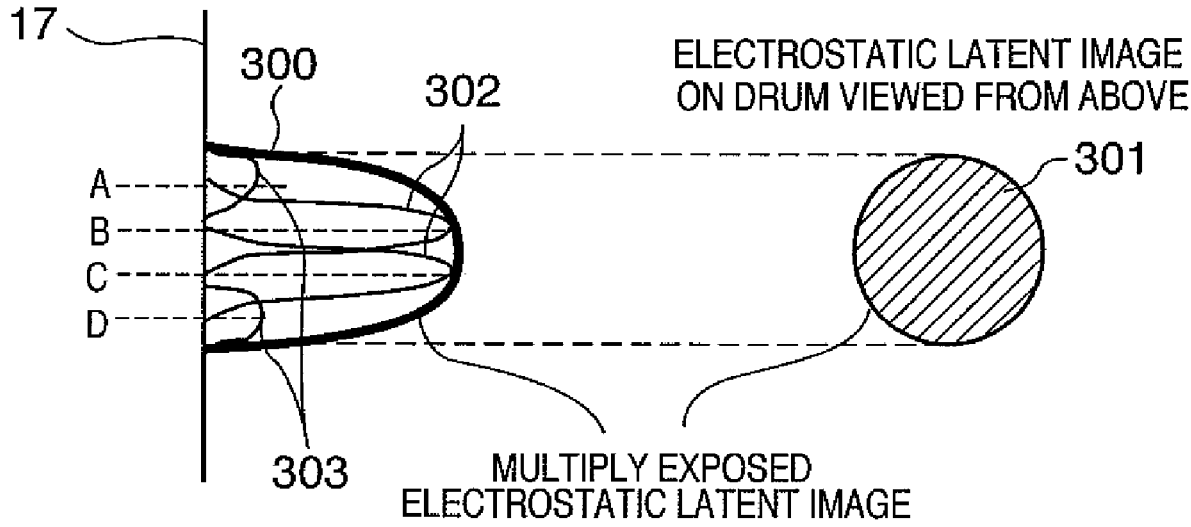
FIG. 3 is a diagram for explaining an electrostatic latent image formed on the photoconductive drum in a case where the four laser beams are irradiated.

FIG. 3 depicts a view explaining an electrostatic latent image formed on the photoconductive drum 17 in a case where the four laser beams overlap.

As represented in FIG. 3, the four laser beams are made to be overlapped on the photoconductive drum 17, whereby a latent image as represented by a thick line 300 can be obtained. Here, reference numeral 302 indicates electrostatic latent images formed by the semiconductor lasers B and C whose amount of light is "4", and reference numeral 303 indicates electrostatic latent images formed by the semiconductor lasers A and D whose amount of light is "1". In this case, the position where the latent image is most deeply formed locates approximately at the center (the middle position between the laser beams) of the four laser beams in the sub-scanning direction. Accordingly, as represented by reference numeral 301 in FIG. 3, a dot can be formed approximately at the center of the width within which the four laser beams are irradiated, in the sub-scanning direction.

Figure 5:
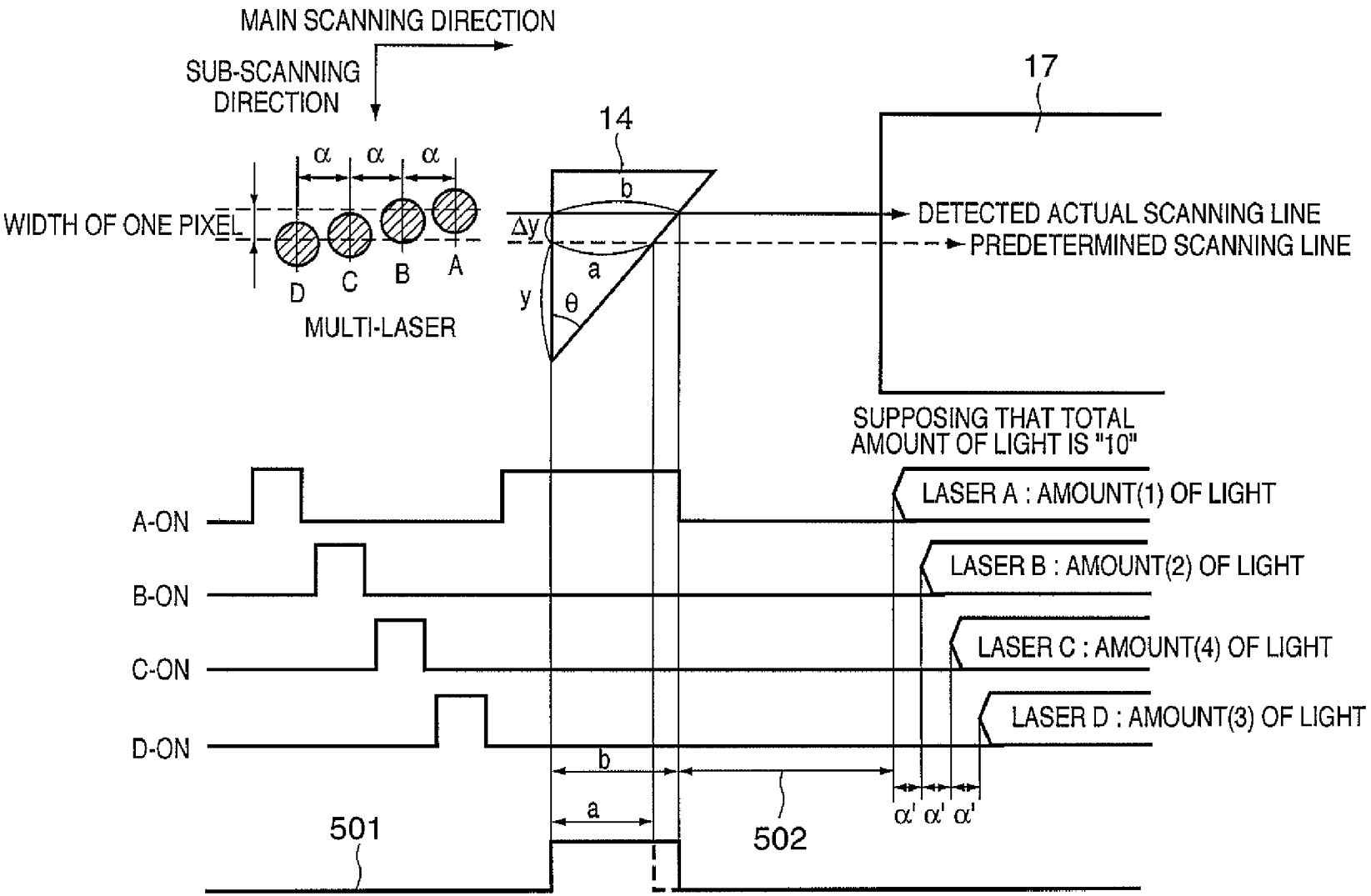
FIG. 5 is a diagram for explaining the relationship among a sensor, a multi-semiconductor laser, a photoconductive drum, and scanning lines of laser beams, and irradiation control signals for respective semiconductor lasers according to the present embodiment.

Next, a case will be explained with reference to FIG. 5. In FIG. 5, due to vibrations or tilt components in a polygon of the image forming apparatus according to the present embodiment, the scanning line of a laser beam is displaced upward in the sub-scanning direction from the desired scanning position.

FIG. 5 is a diagram for explaining the relationship among the sensor 14, the four semiconductor lasers A to D (the Multi-semiconductor laser 3), the photoconductive drum 17, and scanning lines of laser beams and irradiation control signals for respective semiconductor lasers. FIG. 5 is similar to FIG. 2, but FIG. 5, unlike FIG. 2, represents a case where the laser beam is displaced upward in the sub-scanning direction.

In FIG. 5, after the APC control for the semiconductor lasers A through D has sequentially been implemented, the semiconductor laser A is made to emit a laser beam, and the width of a signal 501 detected by the sensor 14 becomes "b" (b>a), i.e., larger than the initial value "a".

As can be seen from FIG. 5, $\tan\theta = a/y = b/(y+\alpha y)$, and the amount of displacement $\alpha y$ is given by the following equation:

$$\Delta y = (b-a)\times y/a = (b-a)/\tan\theta$$

It can be seen that the actual scanning line is displaced from the desired scanning line by "(b−a)/tan θ" upward in the sub-scanning direction. Based on the results of the computing, it is determined that the center of overlapped latent images may be shifted by (b−a)/tan θ downward in the sub-scanning direction.

The light amount control circuit 19 has a table in which the amount of displacement Δy and the amount of laser beam to be emitted from each laser for compensating the displacement Δy are stored, and determines the amount of light for each laser in the time interval 502 represented in FIG. 5, so that the amount of each laser-beam is determined for compensating the displacement. In FIG. 5, the amount of light allotted to the semiconductor laser A is "1", the amount of light allotted to the semiconductor laser B is "2", the amount of light allotted to the semiconductor laser C is, "4", and the amount of light allotted to the semiconductor laser D is "3".

Figure 6:
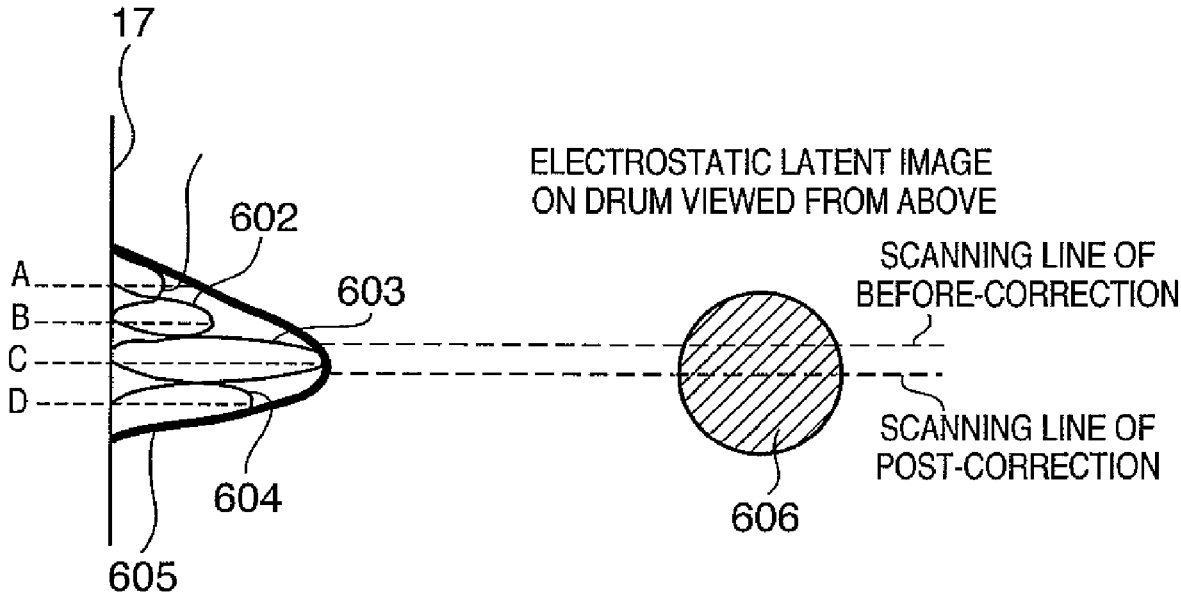
FIG. 6 is a diagram for explaining a condition in which a position of a formed dot is corrected by controlling the amount of a laser beam from each semiconductor laser according to the present embodiment.

FIG. 6 is a diagram for explaining a condition in which the dot forming position on the photoconductive drum 17 is corrected by controlling the amount of a laser beam from each semiconductor laser.

In FIG. 6, electrostatic latent images formed by respective laser beams, as represented by thin lines 601 through 604, are obtained, and the electrostatic latent images are combined to form an electrostatic latent image (dot) represented by a thick line 605. Reference numeral 601 denotes an electrostatic latent image formed by a laser beam (the amount of light "1") from the semiconductor laser A, reference numeral 602 denotes an electrostatic latent image formed by a laser beam (the amount of light "2") from the semiconductor laser B, reference numeral 603 denotes an electrostatic latent image formed by a laser beam (the amount of light "4") from the semiconductor laser C, and reference numeral 604 denotes an electrostatic latent image formed by a laser beam (the amount of light "3") from the semiconductor laser D. In the example, the position where an electrostatic latent image is most deeply formed is located slightly below from the center (the middle between B and C) in the sub-scanning direction. As represented by reference numeral 606 in FIG. 6, a dot can be formed in the main-scanning line that has been corrected so as to be slightly below in the sub-scanning direction.

In addition, similarly, in a case where the actual scanning line is displaced downward from the desired main scanning line, the amount of each laser beam may be determined in the interval 502 for changing allotted amount of each laser beam, in such a way that the position where an electrostatic latent image is most deeply formed is located slightly above the center of the four lasers.

Figure 7:
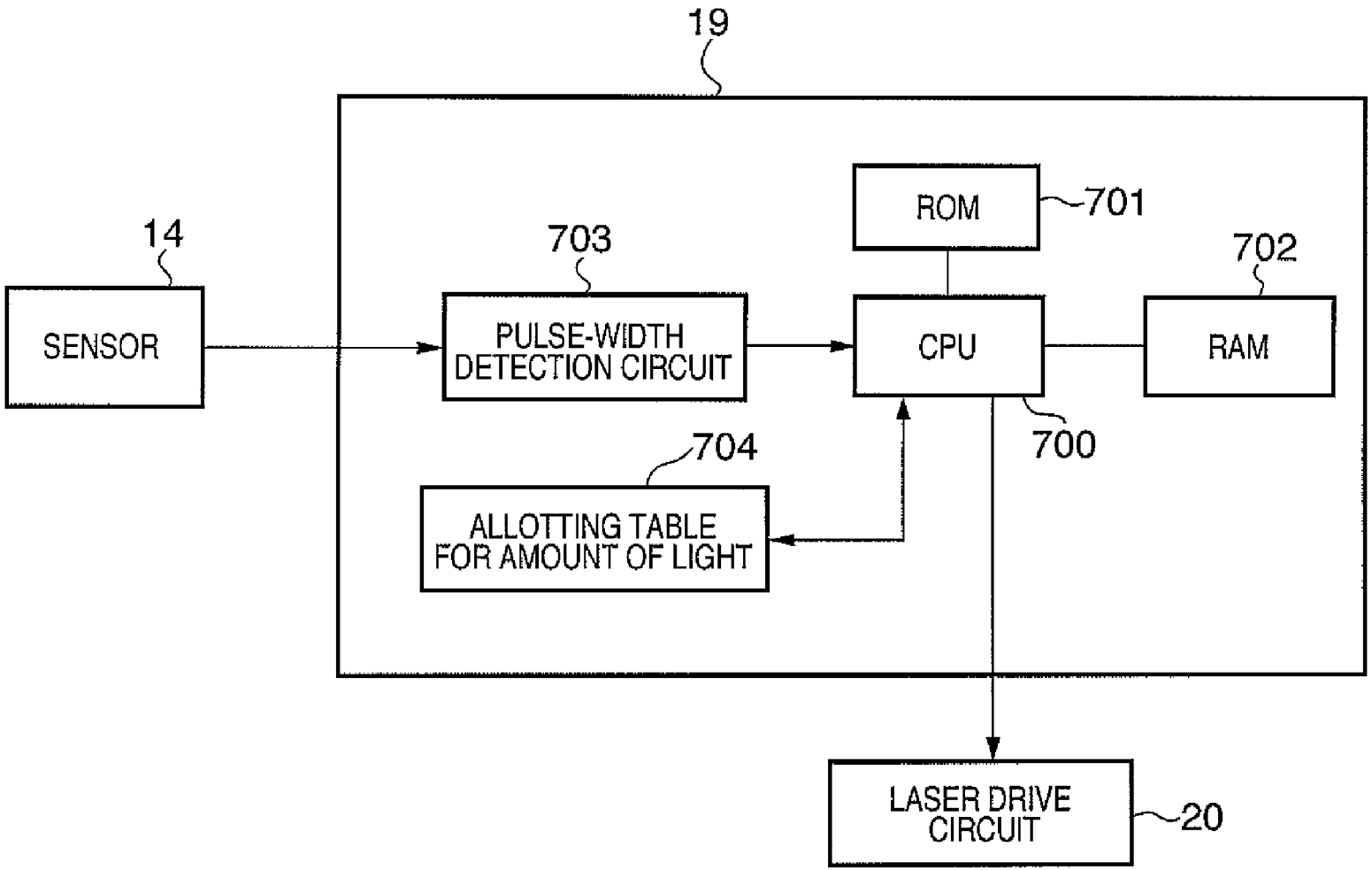
FIG. 7 is a block diagram illustrating a configuration for controlling the amount of irradiation of each semiconductor laser of the multi-semiconductor laser according to the present embodiment.

FIG. 7 is a block diagram illustrating a configuration for controlling the irradiation of each semiconductor laser of the multi-semiconductor laser 3, while mainly illustrating the configuration of the light amount control circuit 19 according to the present embodiment.

A CPU 700 controls the operation of the light amount control circuit 19 in accordance with a control program stored in a ROM 701. A RAM 702 is used as a work area and stores various data items during control processing by the CPU 700. A pulse-width detection circuit 703 detects the pulse width of a signal detected by the sensor 14, and notifies the CPU 700 of the pulse width. As represented in FIGS. 2 and 5, an allotting table 704 for allotting the amount of light stores data for determining the respective amount of irradiation of the semiconductor lasers A to D in accordance with the position of scanning line in the sub-scanning direction (the amount of displacement).

In the configuration described above, the difference (displacement) between a scanning line and the reference position in the sub-scanning direction is obtained in accordance with the pulse width of the signal detected by the sensor 14. Thereafter, in accordance with the amount of the difference and with reference to the allotting table 704, the CPU 700 instructs the laser drive circuit 20 to control the amount of irradiation of each semiconductor laser.

Figure 8:
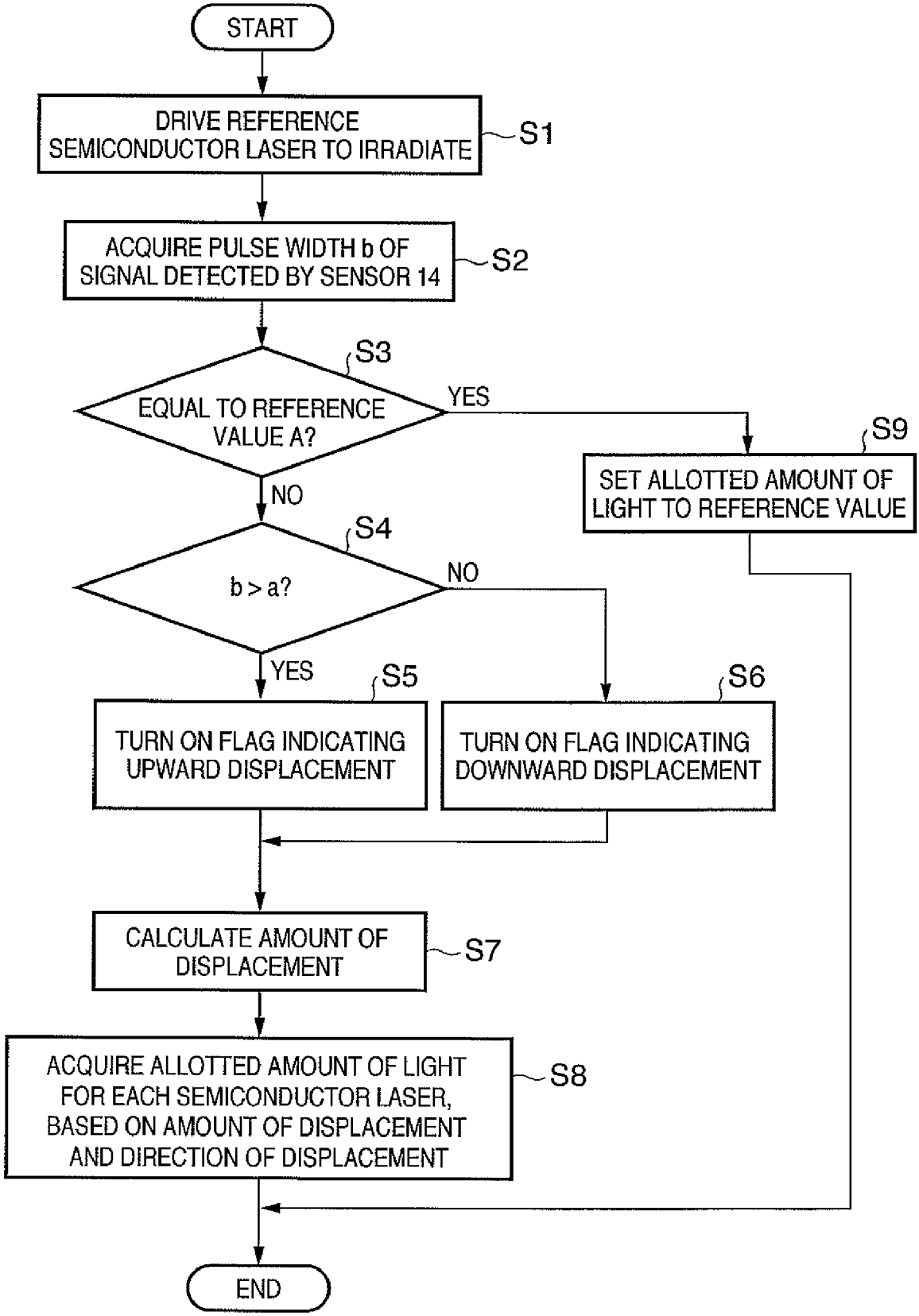
FIG. 8 is a flowchart for explaining processing by a CPU in the light amount control circuit according to the present embodiment.

FIG. 8 is a flowchart for explaining processing by the CPU 700 in the light amount control circuit 19 according to the present embodiment. In addition, the program for implementing the processing is stored in the ROM 701 and implemented under the control of CPU 700.

In the step S1, a semiconductor laser specified as the reference (the semiconductor laser A in the foregoing example) is driven to emit a laser beam. Next, the process proceeds to the step S2, and the pulse width (b) of the signal detected by the sensor 14 is detected by the pulse-width detecting circuit 703. The flow advances to the step S3 and it is determined whether or not the pulse width (b) is equal to the pulse width (a) specified as the reference. If the pulse widths are equal (a=b), the process proceeds to the step S9 because the displacement in the sub-scanning direction does not exist. If not, the process proceeds to the step S4 and it is determined whether the scanning line of the laser beam is displaced upward or downward (b>a or b<a). In the case where the laser beam is displaced upward (b>a) in the step S4, the process proceeds to the step S5 and turns on a flag indicating upward displacement. In contrast, in a case where the laser beam is displaced downward (b<a), the process proceeds to the step S6 and turns on a flag indicating downward displacement. The flag is provided in the RAM 702. Thereafter, in the step S7, the amount of displacement is calculated based on the foregoing equation ($|b-a|/\tan\theta$). Next, in the step S8, the allotted amount of light for each semiconductor laser is determined based on the amount of displacement calculated in the step S7 and on the value of the flag of the RAM 702 set in the step S5 or in the step S6, with reference to the allotting table 704. In consequence, hereafter, each semiconductor laser is driven by the laser drive circuit 20 based on the allotted amount of light for each semiconductor laser.

FIG. 9 depicts an example of table data of the allotting table 704 according to the present embodiment. In FIG. 9, based on the calculated value in accordance with ($|b-a|/\tan\theta$), "amount of displacement" indicates with a rough value an extent of the displacement with respect to the pixel width. Characters A to D correspond to the semiconductor lasers A to D of the multi-semiconductor laser 3. In the table data, the sum of the allotted amount of light for semiconductor lasers A-D is "10". "Upward" or "downward" with regard to "amount of displacement" indicates whether the displacement is upward from the ideal scanning line or downward.

As can be seen from FIG. 9, in a case where the amount of displacement is "0", the amount of light for each semiconductor laser is set ("1" "4" "4" "1") as represented in FIG. 2. Meanwhile, as can be seen from FIGS. 5 and 6, in a case where the scanning line of a laser beam is displaced upward by one several-th of the pixel in the sub-scanning direction, the allotted amount of light for each semiconductor laser is set in such a way that the allotted amount of light for the semiconductor laser A that is situated at the top in the sub-scanning direction is "1"; for the semiconductor laser B, "2"; for the semiconductor laser C, "4"; and the semiconductor laser D, "3", as shown in FIG. 6. FIG. 9 only shows an example of table, and values and the configuration of the table in FIG. 9 are nothing but examples. The present invention, therefore, is not limited thereto.

As described above, in accordance with the amount of displacement of a scanning line in the sub-scanning direction, the respective amounts of laser beams of a plurality of semiconductor lasers are adjusted so that a dot for an electrostatic latent image formed on the photoconductive drum 17 is displaced upward or downward the center of the dot in accordance with the displacement of a laser beam. As the result, the displacement of a laser beam in the sub-scanning direction can be corrected.

The present invention is not limited to the above embodiment, and various changes and modifications can be made thereto within the spirit and scope of the present invention. Therefore, to apprise the public of the scope of the present invention, the following claims are made.

CLAIM OF PRIORITY

This application claims priority from Japanese Patent Application No. 2004-354697 filed on Dec. 7, 2004, which is hereby incorporated by reference herein.

What is claimed is:

1. An image forming apparatus for forming an image by scanning in a main scanning direction laser beams emitted from a plurality of lasers, the image forming apparatus comprising:

a detection unit configured to detect displacement, in a sub-scanning direction, of a main scanning line of a laser beam from one of the plurality of lasers, from a reference position in the sub-scanning direction to determine whether the displacement of the main scanning line of the laser beam from one of the plurality of lasers is upward or downward from the reference position in the sub-scanning direction;

a determination unit configured to determine an allotted amount of light for each of the plurality of lasers in accordance with the displacement detected by the detection unit; and a control unit configured to control driving of each of the plurality of lasers in accordance with the allotted amount of light for each of the plurality of lasers determined by the determination unit, wherein the determination unit allots a different amount of light to at least two of the lasers, wherein the plurality of lasers are arranged evenly spaced, not longer than one-pixel length apart from each other in the sub-scanning direction, and spaced a predetermined distance apart from each other in the main scanning direction, and one pixel is formed by overlapping laser beams from the plurality of lasers, and wherein in a case where the displacement detected by the detection unit is upward from the reference position in the sub-scanning direction, the determination unit determines allotment of light to the plurality of lasers in such a way that allotted amounts of light for the lasers situated at lower side in the sub-scanning direction are larger, and in a case where the displacement is downward from the reference position in the sub-scanning direction, the determination unit determines allotment of light to the plurality of lasers in such a way that allotted amounts of light for the lasers situated at upper side in the sub-scanning direction are larger.

2. The apparatus according to claim 1, wherein the detection unit detects the displacement of the main scanning line in the sub-scanning direction based on a laser beam from a predetermined laser of the plurality of lasers.

3. The apparatus according to claim 1, wherein the detection unit has a sensor for receiving a laser beam from a predetermined laser and generating a signal having a pulse width corresponding to the displacement.

4. An image forming apparatus for forming an image by scanning in a main scanning direction laser beams emitted from a plurality of lasers, the image forming apparatus comprising:

a detection unit configured to detect displacement, in a sub-scanning direction, of a main scanning line of a laser beam from one of the plurality of lasers, from a reference position in the sub-scanning direction to determine whether the displacement of the main scanning line of the laser beam from one of the plurality of lasers is upward or downward from the reference position in the sub-scanning direction;

a determination unit configured to determine an allotted amount of light for each of the plurality of lasers in accordance with the displacement detected by the detection unit; and a control unit configured to control driving of each of the plurality of lasers in accordance with the allotted amount of light for each of the plurality of lasers determined by the determination unit, wherein the determination unit allots a different amount of light to at least two of the lasers, wherein the plurality of lasers are arranged evenly spaced, not longer than one-pixel length apart from each other in the sub-scanning direction, and spaced a predetermined distance apart from each other in the main scanning direction, and one pixel is formed by overlapping laser beams from the plurality of lasers, and wherein in a case where the displacement is not detected by the detection unit, the determination unit determines allotted amounts of light for the lasers situated in the center vicinity of the plurality of lasers larger than amounts of lights for the lasers situated in both ends.

5. An image forming apparatus for forming an image by scanning in a main scanning direction laser beams emitted from a plurality of lasers, the image forming apparatus comprising:

a detection unit configured to detect displacement, in a sub-scanning direction, of a main scanning line of a laser beam from one of the plurality of lasers, from a reference position in the sub-scanning direction to determine whether the displacement of the main scanning line of the laser beam from one of the plurality of lasers is upward or downward from the reference position in the sub-scanning direction;

a determination unit configured to determine an allotted amount of light for each of the plurality of lasers in accordance with the displacement detected by the detection unit; and a control unit configured to control driving of each of the plurality of lasers in accordance with the allotted amount of light for each of the plurality of lasers determined by the determination unit, wherein the determination unit allots a different amount of light to at least two of the lasers, and determines an allotted amount of light for each of the plurality of lasers with reference to a table in which the allotted amount of light for each laser is stored in accordance with the displacement.

6. A control method for an image forming apparatus that forms an image by scanning in a main scanning direction laser beams emitted from a plurality of lasers, the control method comprising:

a detection step of detecting displacement in a sub-scanning direction of a main scanning line of a laser beam from the plurality of lasers, from a reference position in the sub-scanning direction to determine whether the displacement of the main scanning line of the laser beam from one of the plurality of lasers is upward or downward from the reference position in the sub-scanning direction;

a determination step of determining an allotted amount of light for each of the plurality of lasers in accordance with the displacement detected in the detection step; and a control step of controlling driving of each of the plurality of lasers in accordance with the allotted amount of light for each of the plurality of lasers determined in the determination step, wherein the determination step determines a different amount of light allotted to at least two of the lasers, and wherein, in a case where the displacement detected in the detection step is upward from the reference position in the sub-scanning direction, the determination step determines allotment of light to the plurality of lasers in such a way that allotted amounts of light for the lasers situated at lower side in the sub-scanning direction are larger, and in a case where the displacement is downward from the reference position in the sub-scanning direction, the determination step determines allotment of light to the plurality of lasers in such a way that allotted amounts of light for the lasers situated at upper side in the sub-scanning direction are larger.

7. A control method for an image forming apparatus that forms an image by scanning in a main scanning direction laser beams emitted from a plurality of lasers, the control method comprising:

a detection step of detecting displacement in a sub-scanning direction of a main scanning line of a laser beam from the plurality of lasers, from a reference position in the sub-scanning direction to determine whether the displacement of the main scanning line of the laser beam from one of the plurality of lasers is upward or downward from the reference position in the sub-scanning direction;

a determination step of determining an allotted amount of light for each of the plurality of lasers in accordance with the displacement detected in the detection step; and a control step of controlling driving of each of the plurality of lasers in accordance with the allotted amount of light for each of the plurality of lasers determined in the determination step, wherein the determination step determines a different amount of light allotted to at least two of the lasers, and wherein in a case where the displacement detected in the detection step is approximately zero, the determination step determines allotted amounts of light for the lasers situated in the center vicinity of the plurality of lasers larger than those for the lasers situated in both ends.

8. A control method for an image forming apparatus that forms an image by scanning in a main scanning direction laser beams emitted from a plurality of lasers, the control method comprising:

a detection step of detecting displacement in a sub-scanning direction of a main scanning line of a laser beam from the plurality of lasers, from a reference position in the sub-scanning direction to determine whether the displacement of the main scanning line of the laser beam from one of the plurality of lasers is upward or downward from the reference position in the sub-scanning direction;

a determination step of determining an allotted amount of light for each of the plurality of lasers in accordance with the displacement detected in the detection step; and a control step of controlling driving of each of the plurality of lasers in accordance with the allotted amount of light for each of the plurality of lasers determined in the determination step, wherein the determination step determines a different amount of light allotted to at least two of the lasers, and wherein the determination step determines the allotted amount of light for each of the plurality of lasers with reference to a table in which the allotted amount of light for each laser is stored in accordance with the displacement.

* * * * *